US005233921A

United States Patent [19]

John

[11] Patent Number: 5,233,921

[45] Date of Patent: Aug. 10, 1993

[54] PRINTING MACHINE SYSTEM AND INKING METHOD

[75] Inventor: Thomas John, Augsburg, Fed. Rep. of Germany

[73] Assignee: MAN Roland Druckmaschinen AG, Offenbach-am-Main, Fed. Rep. of Germany

[21] Appl. No.: 607,533

[22] Filed: Nov. 1, 1990

[30] Foreign Application Priority Data

Nov. 18, 1989 [DE] Fed. Rep. of Germany ..... 3938449

[51] Int. Cl.[5] ..... B41F 31/00

[52] U.S. Cl. ..... 101/349; 101/478

[58] Field of Search ..... 101/349, 350, 150, 153, 101/212, 400, 401, 478, 487, 488; 29/121.1, 132; 118/46, 212; 346/21, 77 R, 77 B; 400/198; 156/423

[56] References Cited

U.S. PATENT DOCUMENTS

| | | | |
|---|---|---|---|
| 3,382,798 | 5/1968 | Bishop | 101/487 X |
| 3,654,864 | 4/1972 | Ouchinsky | 101/478 X |
| 4,391,879 | 7/1983 | Fabian et al. | 101/153 X |
| 4,549,923 | 10/1985 | Tachibana et al. | 156/423 |
| 4,603,634 | 8/1986 | Fadner | 101/487 |
| 4,793,041 | 12/1988 | Jenkins et al. | 29/121.1 |
| 4,805,530 | 2/1989 | Kobler et al. | 101/350 |
| 4,938,133 | 7/1990 | Bock et al. | 101/349 |

*Primary Examiner*—Edgar S. Burr
*Assistant Examiner*—Ren Yan
*Attorney, Agent, or Firm*—Frishauf, Holtz, Goodman & Woodward

[57] ABSTRACT

To form a cellular surface layer in which the depth or shape of the cells is controllable, the layer is composed of a material which has a temperature-dependent shape retention memory, which is embossed or engraved, without material removal, on a carrier, such as a printing machine cylinder. The temperature of the layer is controlled during application of the embossing and, for example upon drop of temperature, it changes shape to a previously given shape. The depth, size, or presence of cells on the layer can thereby be controlled by controlling the layer temperature, for example by external heaters (9, 26) or by temperature controlling the carrier by a temperature controlled fluid circuit (38).

20 Claims, 4 Drawing Sheets

PRINTING MACHINE SYSTEM AND INKING METHOD

Reference to related patents and applications, the disclosures of which are hereby incorporated by reference, assigned to the assignee of the present application:

U.S. Ser. No. 07/593,039, filed Oct. 5, 1990, John, now U.S. Pat. No. 5,060,571.

U.S. Ser. No. 07/004,772, filed Oct. 26, 1990, John, now U.S. Pat. No. 5,134,936.

U.S. Ser. No. 07/593,040, filed Oct. 5, 1990, John, now abandoned.

U.S. Pat. No. 4,805,530, Kobler et al (to which German 37 06 011 corresponds);

U.S. Pat. No. 4,938,133, Bock et al,

Reference to related literature:

"Maschinenmarkt" ("Machinery Market"), 1987, pp. 58–61 and 70–73. "highTech" Issue 4, 1989.

"Feinwerktechnik und Messtechnik" ("Precision Technology and Measuring Technology"), 95 (1987)7, pages 433 to 435.

FIELD OF THE INVENTION

The present invention relates to a printing system and to a printing machine, and more particularly to a printing carrier, for example a cylinder, which has a cellular surface layer thereon to which ink can be supplied, to be then stripped off by a stripper or, for example, a doctor blade.

DEFINITION

The term "cellular surface" will be used hereinafter to describe an ink transfer surface having small ink receptor depressions or cells, which are used, for example, in anilox rollers or cylinders, gravure cylinders or the like.

A "material which has a temperature dependent shape retention memory" is a metal alloy which has the characteristic that, once deformed, for example mechanically, from an initial state, for example a flat surface, will retain the deformation until, at a given temperature change, it will revert to its initial shape, e.g. a flat surface. This, also, may be termed a one-way effect; a double or reversal way effect, or pseudo elasticity is also possible. This effect may be used for control operations and in drive technology. Elements made of such materials may be sensors, switches, positioning elements and drive elements, all in one. Alloys having such a shape retention memory (SRM) based on iron are of particular interest.

Typical alloys are: CuZn, CuZnAl, CuAlNi; NiTi, NiTiCu, NiTiFe, FePt, FeNiAl, FeNiAlTi. The FePt, FePdd, alloys are very high-cost, and thus probably not suitable for industrial application. It is a requirement for industrial use that the materials are economical, can be manufactured with good reproducibility and quality and have a reasonable lifetime. The iron-nickel-aluminum and iron-nickel-cobalt-titanium alloys are reversible, which can be obtained by precipitation in the high-temperature phase.

The nickel-titanium type materials have higher mechanical strength, but lower electrical conductivity than the copper alloys. The selection of the particular alloys will depend on the requirement for resistance with respect to aging and fatigue. Fissures may result, as well as some changes in the characteristics between the respective states, due to temperatures required for change, and hysteresis. This affects the memory characteristics during use of the material.

The critical temperatures are difficult to control upon manufacture. Typical maximum operating temperatures of iron-nickel-titanium based alloys are in the order of 400° C.; for copper-zinc-aluminum, about 200° C.

The alloys are usually made by a melting-metallurgical process, and worked for the particular use either by plastic deformation or by material removal. Work continues to proceed based on powder metallurgy, and it is hoped that in the future a uniform distribution of elements of the alloys, with a finer texture, or grain or microstructure can be obtained.

Rapid cooling of molten alloys permits manufacture of the alloys in thin ribbons, for example.

In its simplest form, and where only the one-way memory effect is used, a coupling sleeve of the shape retention memory material is made and cooled below its transition temperature. The so cooled sleeve is then expanded, and pushed, for example, about two pipe stubs. The expanded sleeve can easily be pushed over the pipe stubs. Upon then heating the sleeve, the sleeve will remember its original shape and will shrink, thus forming a tight over-sleeve connection. The iron-nickel-titanium alloys are particularly suitable for multiple use, in which, when a second temperature is reached, the worked or deformed state, also, is remembered. Materials based on titanium have advantages with respect to their light weight, resistance to corrosion, and biological compatibility.

The physics of the material, and the change of shape, upon different temperatures and the like, are described in the literature reference "Maschinenmarkt" "Machinery Market"), 1987, pp. 58–61 and 70–73. Other materials are also known, for example based on plastics or man-made materials, and some of them are described in the literature reference "highTech" Issue 4, 1989. The material, by now, is well known, see for example the book "Shape Memory Effects in Alloys" by J. Perkins (ed.), Plenum Press, New York, 1975, and article by McDonald Schetky, L., in the journal "Scientific American", 1979, issue 241, page 68.

THE INVENTION

It is an object to provide a printing system which is so arranged that the quantity of ink carried by a cellular surface layer can be changed without causing wear on the cellular surface layer.

Briefly, the cellular surface layer comprises a material which has a temperature dependent shape retention memory, that is, a material which can be deformed from a first shape to a second shape upon application of mechanical force thereto until, upon application of heat, the material will revert to the first shape. The temperature of this cellular surface layer is then controlled so that the particular shape thereof is controlled.

The term "shape retention memory", as used herein, refers to the characteristics of some materials which, in dependence on the temperature to which they are exposed, can change their surface configuration or shape, for example from a previously deformed configuration to a generally smooth one, or vice versa.

Use of these materials has the additional advantage that the distribution of ink along the carrier, which, if in cylindrical form, would be along the circumference of the cylinder, can be changed by thermally influencing the regions of the carrier, or of the cylinder, respectively.

DRAWINGS

DETAILED DESCRIPTION

The basic principle of the present invention will first be illustrated with reference to a gravure printing system, highly schematically shown in FIG. 1.

Figure 1:
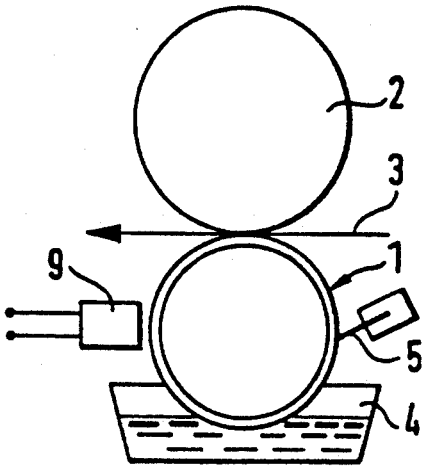
FIG. 1 is a highly schematic side view of a gravure printing system.

The printing system of FIG. 1 includes a gravure forme cylinder 1 and an impression cylinder 2 between which a substrate 3, on which printing is to be carried out, is passed. The gravure printing cylinder 1 dips through a portion of its circumference into ink retained in an ink trough 4. A doctor blade 5 can be engaged against the gravure cylinder 1.

In accordance with a feature of the present invention, the gravure cylinder 1 has a metallic core or carrier 6 on which a porous intermediate layer 7 is applied. The layer 7 can change its volume. It can be applied, for example, by plasma-spraying. In accordance with a feature of the invention, a layer 8 of a material having a temperature-dependent shape or configuration retention memory is applied on the layer 7. This material may be as described above.

In accordance with another feature of the invention, a temperature controlling arrangement 9 is located close to a circumferential position of the gravure forme cylinder 1. This arrangement 9 (see also FIG. 2) includes a plurality of adjacently located heating elements 10. These heating elements are in the form of physically small resistors. Heat sources of this type which provide specific heat generating locations are described, for example, in "Feinwerktechnik und Messtechnik" ("Precision Technology and Measuring Technology"), 95 (1987)7, pages 433 to 435.

Figure 2:
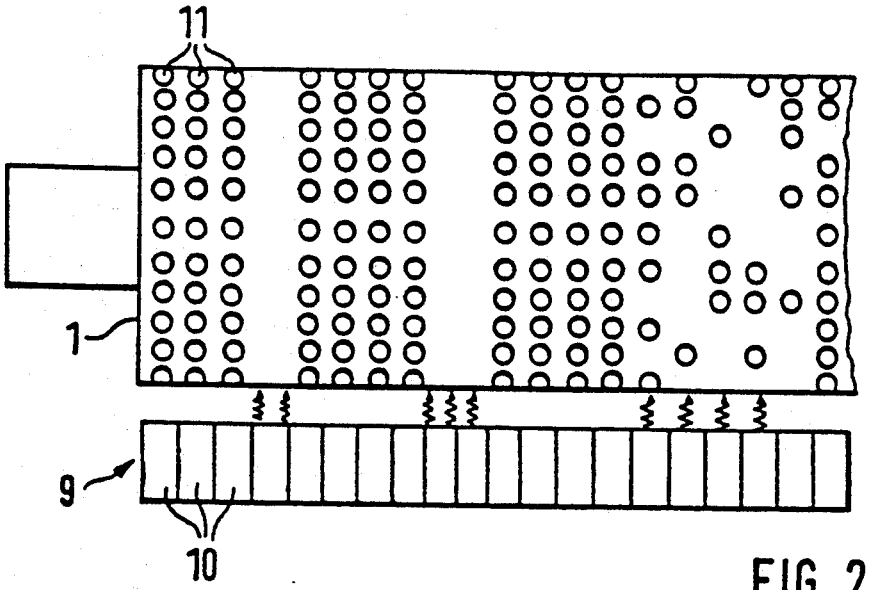
FIG. 2 is a schematic top view of a gravure forme cylinder, thermally coupled to a heat source.
Figure 3:
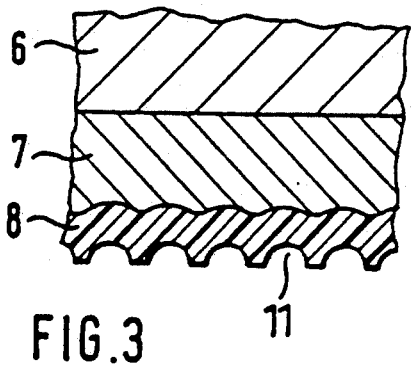
FIG. 3 is a highly enlarged fragmentary sectional view of the cylinder of FIG. 2 in a first state.

As best seen in FIG. 3, the temperature-dependent shape or configuration retention memory of layer 8 is deformed from a first, flat shape (FIG. 4) by introducing into the layer a plurality of cells or depressions 11. This can be done, for example, by embossing, for example by roller-embossing or roller-engraving. FIG. 3 illustrates the shape of the layer 8 in a second physical state. The depressions or cells 11 are located in circumferential rows (see FIG. 2) and each one of the rows of depressions has a heating element 10 associated therewith, as schematically shown in FIG. 2.

OPERATION

Figure 4:
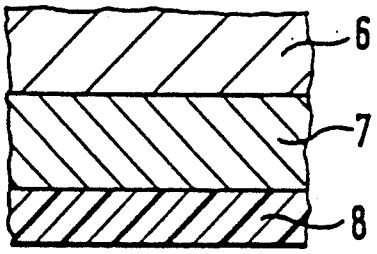
FIG. 4 is a view of FIG. 3 in a second state.

Upon energizing a heating element 10, applying heat to a specific zone on the carrier on which the layer 8 is applied, for example on a circumferential strip of the cylinder 1 upon rotation of the cylinder 1, the region of one or more of the cells 11 in the layer 8 will become heated and, consequently, the layer 8 will deform in this region and will take on the originally flat state or shape, before deformation, as seen in FIG. 4. In this first or physical state, the forme cylinder portion subjected to heating will be part of a cylindrical jacket, flat, or a flat layer if the carrier is a flat plate. The porous intermediate layer 7 ensures that the outer diameter or dimension of the gravure cylinder 1 does not change upon transition between the respective deformed and undeformed state. Layer 7 may also be of temperature-dependent shape retention material.

By stepwise rotation of the gravure cylinder 1, a plurality of individual, single, or all of the cells 11 can be controlled to be cellular or flat. Thus, one or more of the cells 11, upon being subjected to heat from one of the heating elements 10, can change state or, if the heating element 10 is not energized, remain cellular.

FIG. 2 shows, generally, that the arrangement permits erasing a circumferential row of cells or to leave, with respect to a circumferential dimension, leaving alternate cells 11 open, while erasing adjacent cells. Thus, the configuration of cells on the ink carrying substrate can be matched to the subject matter to be printed and reproduced, in general, in the layer 8 of the forme cylinder 1.

Figure 5:
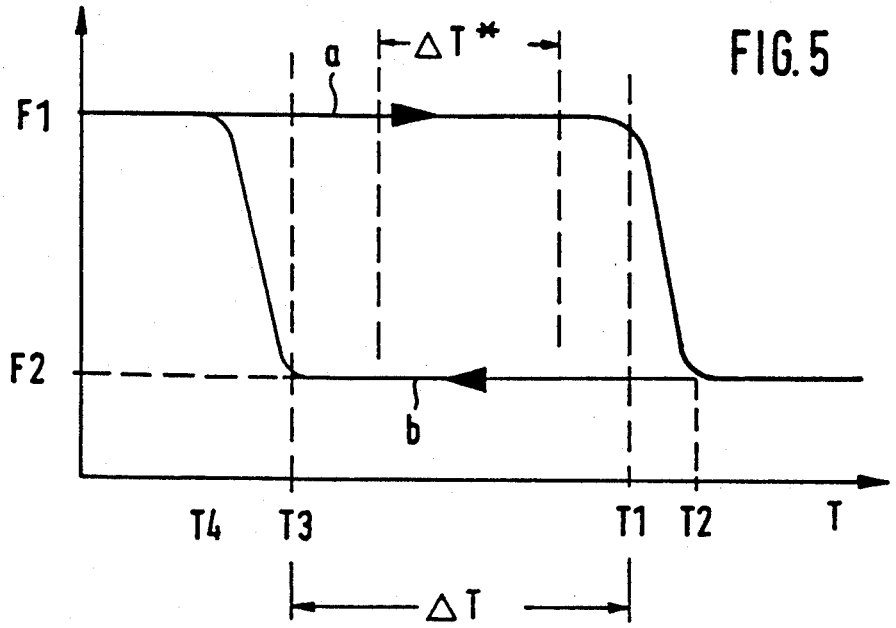
FIG. 5 is a diagram of surface configuration (ordinate) versus temperature (abscissa)

FIG. 5 diagramatically illustrates the change of the state of configuration or of the state of shape of a material having a temperature-dependent shape or configuration retention memory, with respect to temperature. Graph a shows that a second state of shape F1 remains until a temperature T1 is reached. If the temperature is then increased to T2, a first state of shape or configuration F2 will obtain. Graph b then shows the second state of shape or configuration F2 upon drop of temperature until a temperature T3 is reached, which is below the temperatures T1 and T2. Upon further cooling to the temperature T4, the second state F1 again will obtain. As can be seen, the material has substantial hysteresis. Between the temperatures T1 and T3, which forms a range $\Delta T$, the respective state which the material had remains without change. The range of the customary operating temperature of the printing machine can be selected to be within a range $\Delta T^*$, which is placed to fall within the range $\Delta T$. If the machine can be operated in that range $\Delta T^*$, the state of configuration of the material, with cells or a smooth surface, will remain unchanged during the operation of the printing machine.

Figure 6:
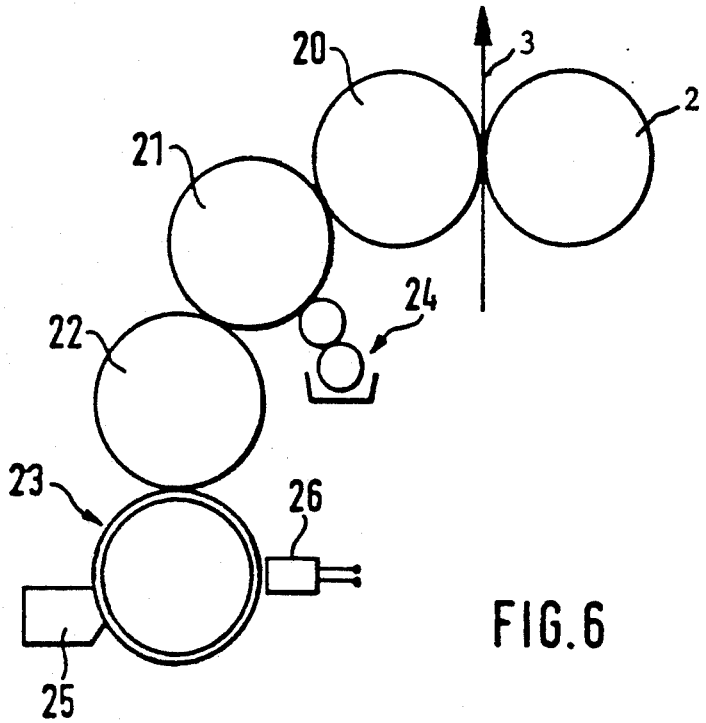
FIG. 6 is a schematic side view of an offset printing system using the present invention.

FIG. 6 illustrates, highly diagramatically, an offset rotary printing machine system. A web 3 is passed between an impression cylinder 2 and an offset blanket cylinder 20, which in turn is in printing engagement with a plate cylinder 21. The plate cylinder 21 is damped by a damper 24. Ink is supplied to the offset plate cylinder 21 by an ink application cylinder or roller 22, having a yielding, ink accepting surface. The application cylinder or roller 22 is in ink transmitting engagement with a cylinder 23, which has a cellular surface. The cylinder 23 receives ink from a chambered doctor blade inker unit 25. A tempering or heat controlling unit 26 is in operative heat transfer relation with the cylinder 23 with the cellular surface. The tempering apparatus 26 is formed as a resistance heater rod extending over the entire width of the cylinder 23. Alternatively, and if desired, the heater rod can be subdivided into portions of different zonal widths, that is, of axial extent matching printing zones. Basically, of course, the heating system 9 of FIG. 2 may also be used. Usually, however, control of individual cells of a cellular surface cylinder 23 is not necessary, and control of the ink transfer in axial zones is usually sufficient.

Figure 7:
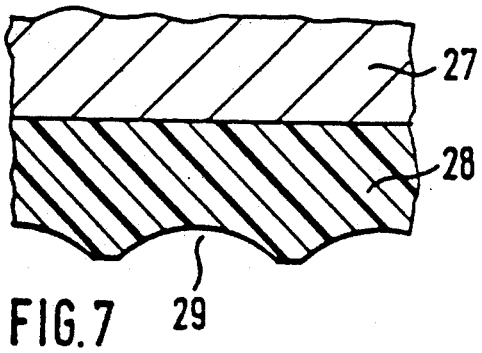
FIG. 7 is a highly enlarged fragmentary sectional view of an ink carrying roller with a cellular surface in a first state.
Figure 8:
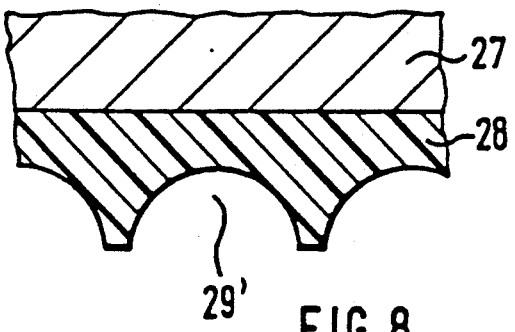
FIG. 8 is a view similar to FIG. 7 in which the cellular surface is in a second state.

The surface of the cylinder 23 is shown highly enlarged and in fragmentary form in FIGS. 7 and 8, in respectively different states. It has a hard metallic core 27 on which a layer 28 of a material with temperature-dependent shape or configuration retention memory is applied. The layer 28 is a porous layer, preferably applied by plasma-spraying. After application of the layer 28, it is deformed, without workpiece removal, to form shallow cells 29 therein, see FIG. 7. This also ensures that the outer circumference of the layer 28 will be a closed surface. The cells 29 are applied to form a first configuration or shape state, while the layer is at the temperature T4 (see FIG. 5). Thereafter, the temperature of the layer 28 is raised to the value T2 (FIG. 5) so that the layer can be again deformed to have the second configuration state. The cells 29' (FIG. 8) of the second state are then given the desired final, deeper shape. Application of the cells on the circumference of the cylinder engraving, without material removal, is by embossing or engraving. The inner porosity of the layer 28 is necessary in order to prevent change of the outer diameter of the cylinder upon transition to the second state. Plasma-spraying is a suitable method of application.

Figure 10:
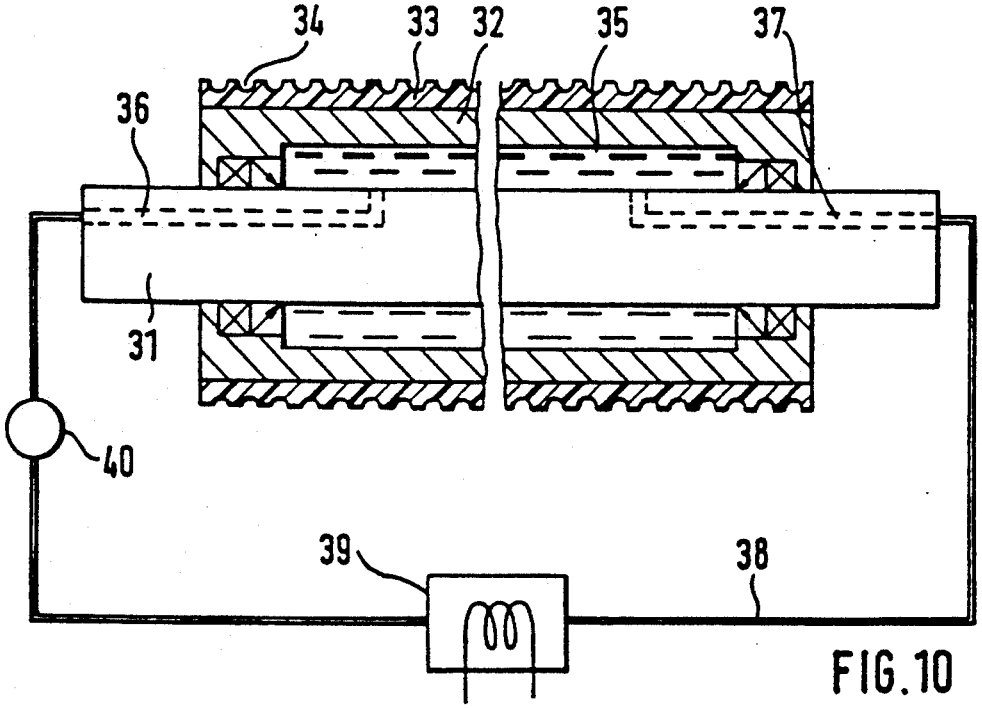
FIG. 10 is a longitudinal sectional view of the cylinder or roller of FIG. 9.
Figure 9:
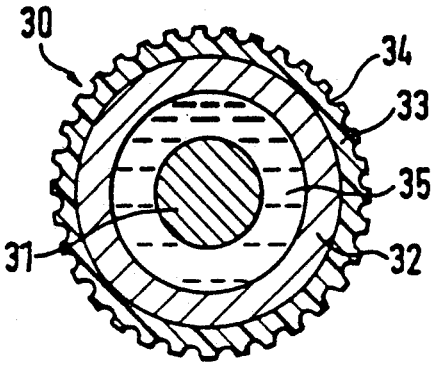
FIG. 9 is a cross-sectional view of a cellular cylinder or roller.

The temperature of the cylinder or roller can be controlled in various ways and, for example, a suitable arrangement is schematically shown in FIGS. 9 and 10. The cylinder 30, with a cellular surface, is rotatably journalled on a fixed shaft 31. It has a metallic core 32 on which porous layer 33 is applied, for example by plasma-spraying. Layer 33 is made of the material with temperature-dependent shape or configuration retention memory. Cells 34 are formed in the layer 33, for example by embossing. The cylinder 30 is formed with a hollow interior space or chamber 35, which is connected via bores 36, 37 to a closed fluid circuit 38. The fluid may, for example, be water. The heat exchanger 39 is located within the fluid circuit or loop 38. The heat exchanger 39 permits, selectively, heating or cooling of the water flowing in the temperature controlling circuit 38. A circulating pump 40 is further included within the circuit 38. Rather than using a single double-acting heat exchanger 39, one heat exchanger can be used to lower the water temperature and another to increase the temperature of the water within the loop 38. Upon increase of the temperature of the water, the layer 33 changes from one state to another, and to return the layer 33 to the first state, the water within the loop 38 can either be cooled, or the ambient temperature to reach the first state can be such that it will obtain automatically when the printing machine is stopped.

Figure 11:
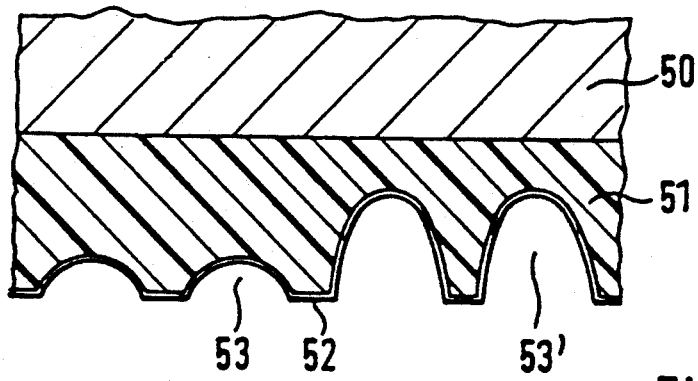
FIG. 11 is a schematic cross-sectional view of another type of ink carrying cellular cylinder.

FIG. 11 illustrates another embodiment in which a layer 51, which is porous, and made of the material which has the temperature-dependent shape or configuration retention memory, is applied to a hard core 50 of a substrate or carrier, for example a printing cylinder, similar to the arrangement in accordance with FIGS. 7 and 8. The cells which are formed in the cylinder have, in a first state 53, a shallow configuration, and, as shown, in a second state 53', a deep configuration. A protective layer 52 to prevent wear of the layer 51 is applied over the layer 51. The protective layer 52 is, suitably, TiN, TiAlN or TiCN, and has a thickness of only a few micrometers.

Figure 12:
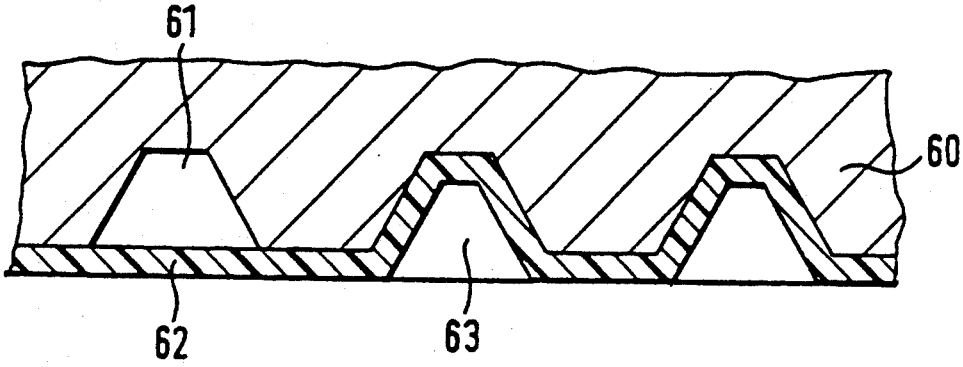
FIG. 12 is a sectional view of yet another type or embodiment of cellular cylinder.

FIG. 12 illustrates another embodiment in which the outer surface of a hard core 60 has depressions 61 formed therein. A layer 62 is applied to the core 60 with the depressions 61, to form a thin-wall sleeve, the layer 62 being made of the material which has a temperature-dependent shape or configuration retention memory. In the state shown at the left side of FIG. 2, the layer 62 forms part of a cylindrical jacket about the core structure 60. When the layer 62 is changed into a second state, by heating, it forms cells 63 in the region of the grooves or depressions or cells 61 within the core 60. The depressions, grooves or cells 61 within the core 60 are so dimensioned that they can accept the layer 62 when it enters the cells 61 to form the cells 63 at the outer circumference.

This arrangement is suitable not only for cellular rollers, for example anilox rollers, but also for gravure forme cylinders. This embodiment also permits an arrangement in which the layer 62, in a first state, already forms shallow cells, as shown for example by the cells 29 (FIG. 7), which then can be changed to the deep cells 63, corresponding to the cells 29' of FIG. 8. Such an arrangement is particularly suitable for anilox rollers, or other types of rollers transferring printing ink.

Various changes and modifications may be made, and any features described herein may be used with any of the others, within the scope of the inventive concept.

The thickness of the layer with the temperature-dependent shape retention memory will depend on its use, and on whether the layer itself is porous or has a porous underlayer 7 (see FIGS. 3, 4). For example, the layer 8 (FIGS. 3, 4) may have a thickness of 0.1–2 mm.

Layer 7, which itself can be of the material which has a temperature-dependent shape retention memory, may have a thickness of 0.1–2 mm. If layer 7 is made of a different porous, but volume-changeable material, a suitable material is Vulkolan=Polyurethan of a thickness of 1–5 mm. If the layer itself is porous, then, for example, layer 28 (FIGS. 7, 8) may have a thickness of about 2 mm. The sleeve 62 (FIG. 12) may have a thickness of 0.05–0.5 mm.

Typical temperature ranges are (with reference to FIG. 5):

T4: 20° C.
T3: 30° C.
T1: 50° C.
T2: 60° C.

I claim:

1. Printing system for a printing machine having a carrier (1, 23, 30; 6, 27, 32, 50, 60);

a cellular surface layer (8, 29, 33, 51, 62) formed with ink receptor cells (18, 29, 34, 53, 63) supported on the carrier; and means (4, 25) for supplying ink to said ink receptor cells on the cellular surface layer, and wherein, in accordance with the invention, said cellular layer (8, 28, 33, 51, 62) comprises a material which has a temperature-dependent shape retention memory which is defined as a material which can be deformed from a first shape to a second shape upon application of mechanical force thereto until, upon application of heat, it will revert to the first shape;

means (9, 26, 35–40) are provided for controlling the temperature of said cellular surface layer;

wherein a porous intermediate layer (7) is provided, located between the carrier and said cellular surface layer (8, 28, 33, 51, 62) of temperature-dependent shape retention memory material and the carrier, said intermediate layer (7) being porous and capable of changing its volume; and wherein the intermediate layer (7) comprises the material having the temperature-dependent shape retention memory.

2. The system of claim 1, wherein said carrier comprises a cylinder (1, 23, 30) having a core (6, 27, 32, 50, 60).

3. The system of claim 1, further including a protective layer (52) supplied at the outer circumference of the cellular surface layer of the temperature-dependent shape retention memory to provide protection against wear of said cellular surface layer.

4. The system of claim 1, wherein said carrier comprises a gravure printing forme.

5. The system of claim 1, wherein said carrier is cylindrical and comprises a gravure printing forme cylinder.

6. The system of claim 1, wherein said carrier is cylindrical and comprises a cellular roller of a printing machine inker system.

7. The system of claim 1, wherein said means (9) for controlling the temperature of said cellular surface layer comprises a plurality of adjacently located resistance elements (10).

8. The system of claim 1, wherein said means (26) for controlling the temperature of said cellular surface layer comprises at least one heating element extending transversely across said carrier.

9. The system of claim 1, wherein said carrier comprises a cylinder (30, 32) which is hollow and defines an interior hollow chamber (35);

and wherein said means (35–40) for controlling the temperature of the cellular layer comprises a heat exchange fluid loop (38) coupled to said hollow chamber (35), and means (39) for controlling the temperature of the heat exchange fluid within said loop.

10. Printing system for a printing machine having a carrier (60);

a cellular surface layer (8, 29, 33, 51, 62) formed with ink receptor cells (18, 29, 34, 53, 63) supported on the carrier; and means (4, 25) for supplying ink to said ink receptor cells on the cellular surface layer, and wherein, in accordance with the invention, said cellular surface layer (62) comprises a material which has a temperature-dependent shape retention memory which is defined as a material which can be deformed from a first shape to a second shape upon application of mechanical force thereto until, upon application of heat, it will revert to the first shape;

means (9, 26, 35–40) are provided for controlling the temperature of said cellular surface layer;

wherein said carrier comprises a cylinder (60);

said cellular layer (62) of temperature-dependent shape retention memory comprises a thin-wall sleeve fitted over the cylinder (60); and wherein the external circumference of the cylinder (60) is formed with depressions or cells (61), dimensioned to have the maximum size or depth of cells required by the printing system, and positioned beneath thermally deformable regions of said cellular layer (62).

11. The system of claim 10, further including a protective layer (52) supplied at the outer circumference of the cellular surface layer (62) of the temperature-dependent shape retention memory to provide protection against wear of said cellular surface layer.

12. The system of claim 10, wherein said sleeve (62) comprises a gravure printing forme.

13. The system of claim 10, wherein said carrier comprises a cellular roller of a printing machine inker system.

14. The system of claim 10, wherein said means (9) for controlling the temperature of said cellular surface layer comprises a plurality of adjacently located resistance elements (10).

15. The system of claim 10, wherein said means (26) for controlling the temperature of said cellular surface layer comprises at least one heating element extending transversely across said carrier.

16. The system of claim 10, wherein said cylindrical carrier (60) is hollow and defines an interior hollow chamber (35);

and wherein said means (35–40) for controlling the temperature of the cellular layer comprises a heat exchange fluid loop (38) coupled to said hollow chamber (35), and means (39) for controlling the temperature of the heat exchange fluid within said loop.

17. A method of controlling the quantity of ink on a carrier (1, 23, 30; 6, 27, 32, 50, 60) of a printing machine, wherein the carrier of the printing machine has a surface layer (8, 28, 33, 51, 62) formed with ink receptor cells (18, 29, 34, 53, 63) to define a cellular configuration supported on the carrier; and means (4, 25) for supplying ink to said ink receptor cells on the cellular surface layer, and wherein the method controls the quantity of ink accepted by said ink receptor cells, said method comprising providing an essentially smooth, porous surface layer (8, 28, 33, 51, 62) of a material which has a temperature-dependent shape retention memory which is defined as a material which can be deformed from a first shape to a second shape upon application of mechanical force thereto until, upon application of heat, it will revert to the first shape;

deforming said surface layer (8, 28, 33, 51, 62) having the temperature-dependent shape retention memory by mechanical embossing of the layer without material removal, to form cells in the surface layer and thus provide a cellular surface layer; and;

controlling the temperature of said cellular surface layer to thereby control the shape of the cells in said cellular surface layer and hence of the quantity of ink which can be accepted in the so-controlled cells.

18. The method of claim 17, further including the step of applying a wear-protecting layer (52) over said cellular surface layer.

19. The method of claim 17, wherein the step of providing said cellular surface layer (8, 28, 33, 51, 62) comprises applying said material of temperature-dependent shape retention memory on the carrier by plasma-spraying.

20. The method of claim 17, wherein said carrier comprises a printing machine cylinder or roller.

* * * * *